US011167884B2

(12) United States Patent
Kim et al.

(10) Patent No.: US 11,167,884 B2
(45) Date of Patent: Nov. 9, 2021

(54) FRAME PACKAGING BOX

(71) Applicant: Samsung Electronics Co., Ltd., Suwon-si (KR)

(72) Inventors: Gyeong Joong Kim, Suwon-si (KR); Seung Sik Tak, Suwon-si (KR); Yong Seung Shin, Suwon-si (KR); Seo Joon Lee, Suwon-si (KR); Yong Soon Lee, Suwon-si (KR); Kuk Hyun Ji, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/962,343

(22) PCT Filed: Jan. 17, 2019

(86) PCT No.: PCT/KR2019/000706
§ 371 (c)(1),
(2) Date: Jul. 15, 2020

(87) PCT Pub. No.: WO2019/151683
PCT Pub. Date: Aug. 8, 2019

(65) Prior Publication Data

US 2020/0339306 A1 Oct. 29, 2020

(30) Foreign Application Priority Data

Jan. 30, 2018 (KR) ..... 10-2018-0011398

(51) Int. Cl.
*B65D 25/10* (2006.01)
*B65D 85/30* (2006.01)

(52) U.S. Cl.
CPC ..... *B65D 25/108* (2013.01); *B65D 85/30* (2013.01)

(58) Field of Classification Search
CPC ..... B65D 25/10; B65D 25/108; B65D 81/02; B65D 81/05; B65D 81/053; B65D 81/057; B65D 85/30; B65D 85/48
USPC ..... 206/449, 453, 454
See application file for complete search history.

(56) References Cited

U.S. PATENT DOCUMENTS 5,518,118 A * 5/1996 Putz ..... B65D 25/10 206/449
7,644,820 B2 * 1/2010 Hohne ..... B65D 81/057 206/449
8,905,239 B2 * 12/2014 Kim ..... H01L 21/6732 206/454

FOREIGN PATENT DOCUMENTS

JP 2011-37474 2/2011
JP 2012-188122 10/2012
JP 2013-180787 9/2013
JP 2014-19486 2/2014
(Continued)

OTHER PUBLICATIONS

International Search Report dated May 15, 2019 in corresponding International Patent Application No. PCT/KR2019/000706.

*Primary Examiner* — Bryon P Gehman
(74) *Attorney, Agent, or Firm* — Staas & Halsey, LLP

(57) ABSTRACT

The present disclosure relates to a frame packaging box for packaging frames. The frame packaging box includes a box comprising an accommodating space for accommodating frames, a plurality of supporters stacked up and down in the accommodating space to support portions of the frames, and a guide rail disposed on an inner surface of the box to guide the up-down movement of the plurality of supporters.

17 Claims, 9 Drawing Sheets

(56) References Cited

FOREIGN PATENT DOCUMENTS

KR 10-1104849 1/2012

* cited by examiner

FRAME PACKAGING BOX

CROSS-REFERENCE TO RELATED APPLICATIONS

This application is a U.S. National Stage Application which claims the benefit under 35 U.S.C. § 371 of International Patent Application No. PCT/KR2019/000706 filed on Jan. 17, 2019, which claims foreign priority benefit under 35 U.S.C. § 119 of Korean Patent Application No. 10-2018-0011398 filed on Jan. 30, 2018, in the Korean Intellectual Property Office, the contents of all of which are incorporated herein by reference.

TECHNICAL FIELD

The present disclosure relates to a frame packaging box for accommodating frames forming an outer appearance of an electronic product.

BACKGROUND ART

Generally, a display apparatus includes a display panel forming a screen and a case accommodating the display panel.

In such a display apparatus, recently, a side case formed by a quadrangular ring-shaped frame is configured to cover the top, bottom, left, and right sides of the display panel to minimize a bezel of the display apparatus.

The frame is formed by bending a bar-shaped member into the shape of a quadrangular ring, and a plurality of the frames is stored and transported in a state of being loaded in one box.

DISCLOSURE

Technical Problem

The present disclosure is directed to providing a frame packaging box capable of more efficiently packaging a plurality of frames.

Technical Solution

One aspect of the present disclosure provides a frame packaging box including a box comprising an accommodating space for accommodating frames, a plurality of supporters stacked up and down in the accommodating space to support portions of the frames, and a guide rail disposed on an inner surface of the box to guide the up-down movement of the plurality of supporters.

The plurality of supporters may include a support portion having an upper surface on which a seating groove on which the portion of the frame is seated is formed, and a guide portion extending from one side of the support portion and movably installed on the guide rail.

Each of the plurality of supporters may include a support protrusion extending from the upper surface of the support portion, and a support groove formed concavely on a lower surface of the support portion and into which the support protrusion of the supporter located thereunder is inserted.

The plurality of supporters may include a corner portion supporter supporting a corner portion of the frame, and the corner portion supporter may include the seating groove formed in an L shape.

The support protrusion may include an L-shaped outer support protrusion provided on an outer upper surface with respect to the seating groove, and an inner support protrusion provided on an inner upper surface with respect to the seating groove, and the support groove may include an L-shaped outer support groove corresponding to the outer support protrusion, and an inner support groove corresponding to the inner support protrusion.

The plurality of supporters may include a straight portion supporter supporting a straight portion of the frame, and the straight portion supporter may include the seating groove formed in a straight shape.

The support protrusion may include a straight-shaped first support protrusion provided on an outer upper surface with respect to the seating groove, and a straight-shaped second support protrusion provided on an inner upper surface with respect to the seating groove, and the support groove may include a straight-shaped outer support groove corresponding to the outer support protrusion, and a straight-shaped inner support groove corresponding to the inner support protrusion.

Another aspect of the present disclosure provides a frame packaging box including a box comprising an accommodating space for together accommodating first frames and second frames smaller than the first frames, a plurality of first supporters disposed adjacent to an inner surface of the box and stacked up and down to support portions of the first frames, and a plurality of second supporters disposed to be spaced apart from an inner side of the plurality of first supporters to support portions of the second frames.

The box may include a guide rail disposed on an inner surface of the box to guide the up-down movement of the plurality of first supporters.

The first supporter may include a support portion having an upper surface on which a seating groove on which the portion of the first frame is seated is formed, and a guide portion connected to one side of the support portion and movably installed on the guide rail.

The first supporter may include a plurality of first corner portion supporters disposed adjacent to corner portions of the box to support corner portions of the first frames, and a plurality of first straight portion supporters disposed between the plurality of first corner portion supporters to support straight portions of the first frames.

The plurality of first corner portion supporters may include the seating groove formed in an L shape, and the plurality of first straight portion supporters may include the seating groove formed in a straight shape.

The second supporter may include a support portion having an upper surface on which a seating groove on which the portion of the second frame is seated is formed.

The second supporter may include a plurality of second corner portion supporters disposed adjacent to corner portions of the box to support corner portions of the second frames, and a plurality of second straight portion supporters disposed between the plurality of second corner portion supporters to support straight portions of the second frames.

The box may further include bottom spacers configured to maintain the first supporters forming the lowermost layer among the plurality of first supporters and the second supporters forming the lowermost layer among the plurality of second supporters in a state of being spaced apart from each other, and top spacers configured to maintain the first supporters forming the uppermost layer among the plurality of first supporters and the second supporters forming the uppermost layer among the plurality of second supporters in a state of being spaced apart from each other.

Each of the plurality of first supporters and each of the plurality of second supporters may include support protrusions extending from upper surface thereof, and support grooves formed concavely on lower surface thereof and into which the support protrusions are inserted.

Each of the bottom spacers may include first spacer protrusions inserted into the support grooves of the first supporters, and second spacer protrusions inserted into the support grooves of the second supporters.

Each of the top spacers may include first spacer holes into which the support protrusions of the first supporters are inserted, and second spacer holes into which the support protrusions of the second supporters are inserted.

Advantageous Effects

In accordance with a frame packaging box of the present disclosure, because supporters supporting frames are sequentially stacked through guide rails, the supporters can be more easily arranged in the frame packaging box.

Further, in accordance with a frame packaging box of the present disclosure, a first frame and a second frame smaller than the first frame can be simultaneously accommodated in the frame packaging box through first supporters and second supporters disposed to be spaced apart in an inner side of the first supporters.

MODE OF THE DISCLOSURE

Figure 1:
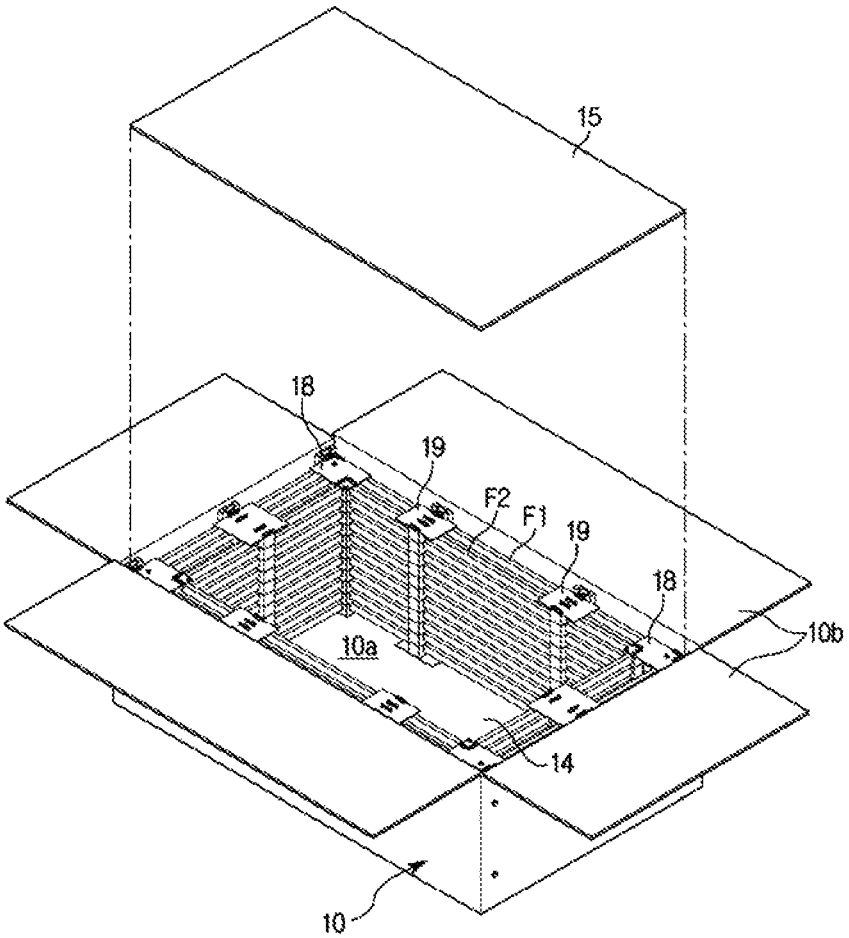
FIG. 1 is a perspective view of a frame packaging box according to an embodiment of the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

In this specification, the terms "front end," "rear end," "upper portion," "lower portion," "upper end" and "lower end" used in the following description are defined with reference to the drawings, and the shape and position of each component are not limited by these terms.

Hereinafter, embodiments of the present disclosure will be described in detail with reference to the accompanying drawings.

Figure 4:
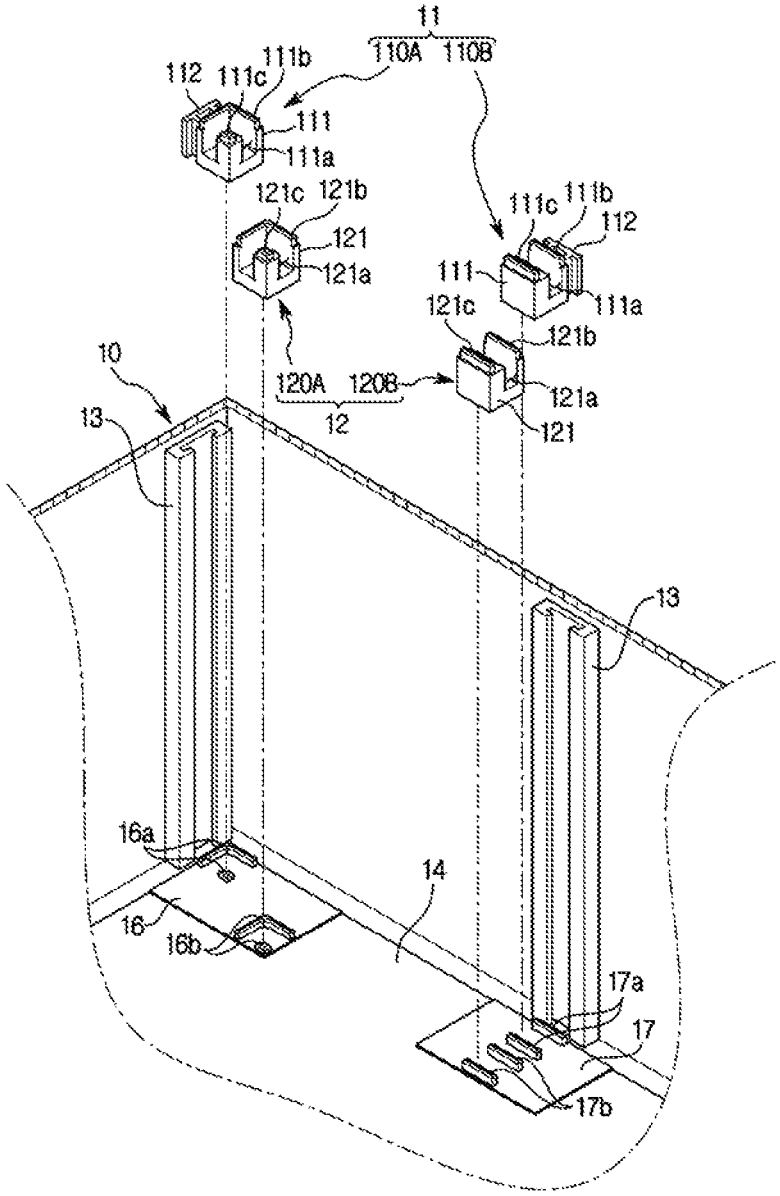
FIG. 4 is a partial perspective view illustrating a process in which supporters are installed in the frame packaging box according to an embodiment of the present disclosure.

As illustrated in FIGS. 1 and 4, a frame packaging box 1 includes a box 10 forming an accommodating space 10*a* in which frames F1 and F2 are accommodated, supporters 11 and 12 stacked up and down in the box 10 to support the frames F1 and F2, and guide rails 13 guiding the up and down movements of the supporters 11 and 12.

The box 10 is formed in a box shape with an upper side open to form the accommodating space 10*a* in the inside thereof, and includes four of cover portions 10*b* connected to the upper side thereof to close the accommodating space 10*a*.

In the present embodiment, the accommodating space 10*a* of the box 10 accommodates the first frames F1 having a quadrangular ring shape, and the second frames F2 formed of a rectangular ring having a smaller size than the first frames F1 to be accommodated in the first frames F1.

The box 10 includes a bottom cover 14 (see FIG. 2) formed in a quadrangular plate shape to cover a bottom surface of the box 10, and a top cover 15 formed in a quadrangular plate shape to cover upper sides of the frames F1 and F2 after the frames F1 and F2 is completely accommodated in the accommodating space 10*a*.

The guide rail 13 extends vertically and is fixed to an inner surface of the box 10 through screws or double-sided tape. A plurality of the guide rails 13 is arranged to be spaced apart from each other on the inner surface of the box 10.

The supporters 11 and 12 are formed of a resin material and may be mass produced through a method such as injection molding. Therefore, not only may the supporters 11 and 12 be easily produced, they may be collected and reused after being used.

The supporters 11 and 12 include the first supporters 11 supporting the first frames F1, and the second supporters 12 disposed to be spaced apart from inner sides of the first supporters 11 to support the second frames F2.

Accordingly, the first frames F1 and the second frames F2 smaller than the first frames F1 may be simultaneously accommodated in one of the box 10.

The first supporter 11 includes a first support portion 111 supporting a portion of the first frame F1, and a guide portion 112 connected to one side of the first support portion 111 to allow the guide rail 13 to move up and down. The second supporter 12 includes a second support portion 121 supporting a portion of the second frame F2. The first support portion 111 of the first supporter 11 and the second support portion 121 of the second supporter 12 have substantially the same shape, and the first supporter 11 is formed in a shape in which the guide portion 112 is added to the second supporter 12.

The support portions 111 and 121 are formed in a substantially quadrangular block shape, and include seating grooves 111*a* and 121*a* provided on upper surfaces thereof, respectively, to seat the portion of the frames F1 and F2. The seating grooves 111*a* and 121*a* may be formed in an L shape to correspond to corner portions of the frames F1 and F2, or may be formed in a straight shape to correspond to straight portions of the frames F1 and F2.

Therefore, the supporters 11 and 12 are divided into corner portion supporters 110A and 120A supporting the corner portions of the frame F1 and F2 and straight portion supporters 110B and 120B supporting the straight portions of the frame F1 and F2 depending on the shape of the seating grooves 111*a* and 121*a* provided on the support portions 111 and 121. That is, the first supporter 11 includes the first corner portion supporter 110A and the first straight portion supporter 110B, and the second supporter 12 includes the second corner portion supporter 120A and the second straight portion supporter 120B.

In the present embodiment, one of the first frame F1 is supported by four of the first corner portion supporters 110A and six of the first straight portion supporters 110B, and one of the second frame F2 is supported by four of the second corner portion supporters 120A and six of the second straight portion supporters 120B. That is, each of the first frames F1 is supported by ten of the first supporters 11, and each of the second frames F2 is supported by ten of the second supporters 12.

The supporters 11 and 12 include support protrusions 111*b*, 111*c*, 121*b*, and 121*c* protruding from the upper surfaces of the support portions 111 and 121, and support grooves 111*d*, 111*e*, 121*d*, and 121*e* formed concavely on lower surfaces of the support portions 111, 121 to allow the support protrusions 111*b*, 111*c*, 121*b*, and 121*c* of the other supporters 11 and 12 placed thereunder to be inserted, respectively.

The support protrusions 111*b*, 111*c*, 121*b*, and 121*c* include the outer support protrusions 111*b* and 121*b* located at an outer side with respect to the seating grooves 111*a* and 121*a*, and the inner support protrusions 111*c* and 121*c* located at an inner side with respect to the seating grooves 111*a* and 121*a*, and the support grooves 111*d*, 111*e*, 121*d*, and 121*e* include the outer support grooves 111*d* and 121*d* corresponding to the outer support protrusions 111*b* and 121*b*, and the inner support grooves 111*e* and 121*e* corresponding to the inner support protrusions 111*c* and 121*c*.

Figure 5:
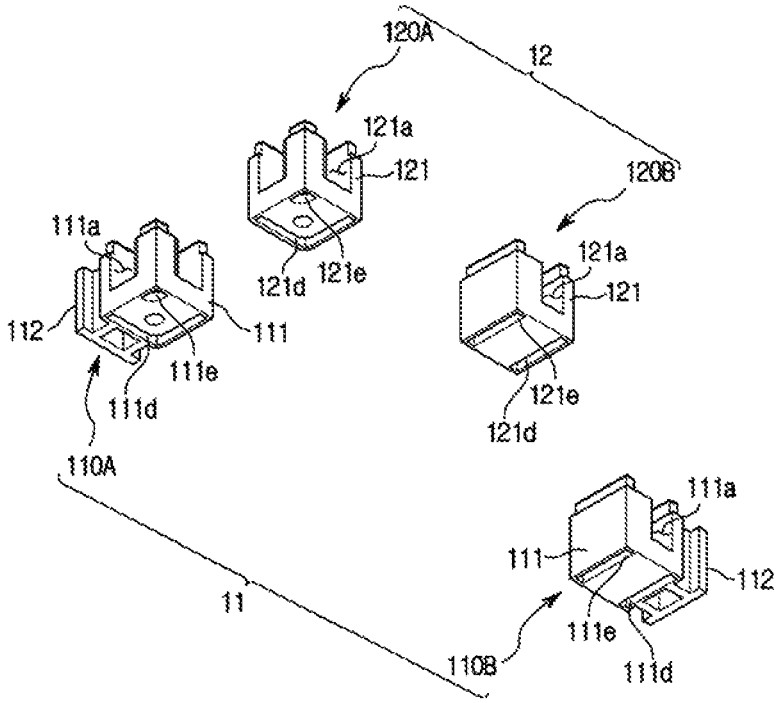
FIG. 5 is a bottom perspective view of the supporters applied to the frame packaging box according to an embodiment of the present disclosure.

As illustrated in FIG. 5, the first corner portion supporters 110A and the second corner portion supporters 110B include the L-shaped outer support protrusions 111*b* and 121*b* and L-shaped outer support grooves 111*d* and 121*d*, respectively, and the first straight portion supporters 110B and the second straight portion supporters 120B include the outer support grooves 111*d* and 121*d* and the inner support protrusions 111*b* and 121*b* formed in the straight shape, respectively. In the above, the expression "outer side" refers to a portion adjacent to the inner surface of the box 10 with respect to the seating grooves 111*a* and 121*a* in the supporters 11 and 12, and the expression "inner side" refers to a portion adjacent to the inner center of the box 10 with respect to the seating grooves 111*a* and 121*a* in the supporters 11 and 12.

Accordingly, because the supporters 11 and 12 are supported by the other supporters 11 and 12 placed thereon and thereunder through the support protrusions 111*b*, 111*c*, 121*b*, and 121*c* and the support grooves 111*d*, 111*e*, 121*d*, and 121*e*, the supporters 11 and 12 may be stably maintained in a state of being stacked up and down.

Figure 3:
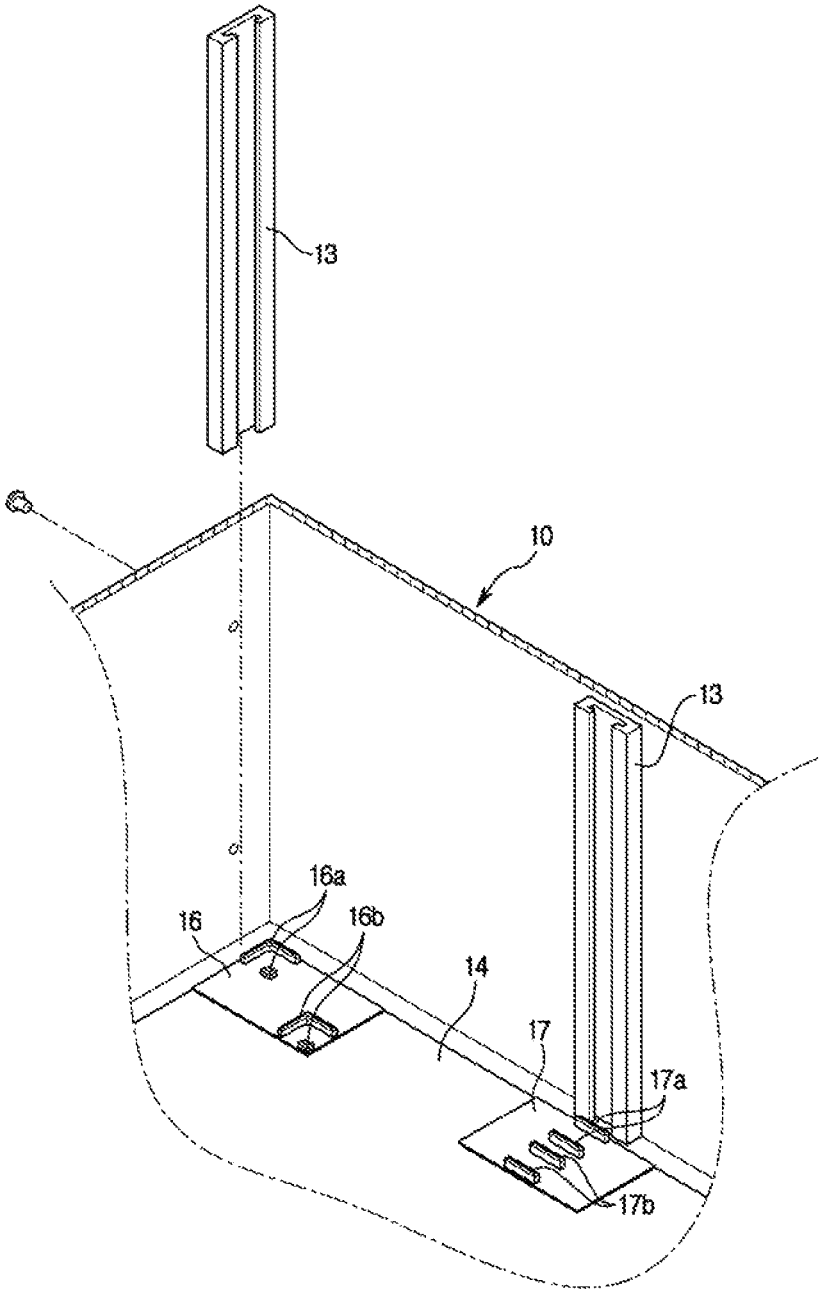
FIG. 3 is a partial perspective view illustrating a process in which a guide rail is installed in the box in the frame packaging box according to an embodiment of the present disclosure.
Figure 8:
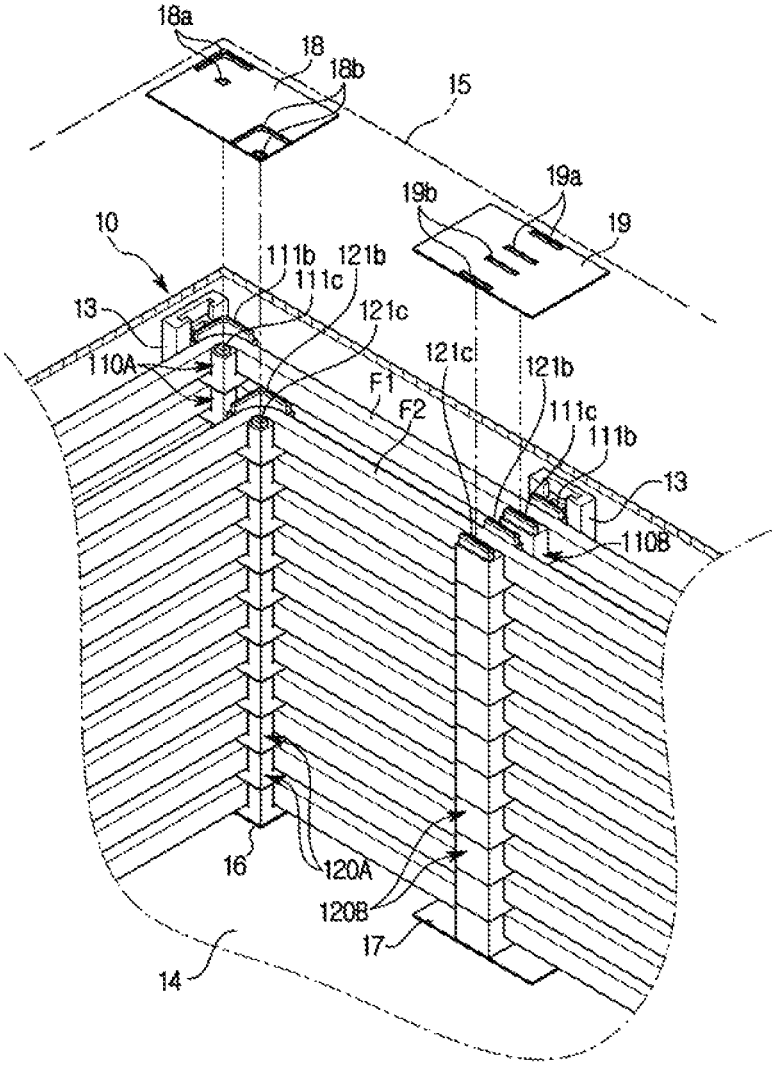
FIGS. 8 and 9 are partial perspective views illustrating a process in which a top cover is installed after the frames are completely accommodated in the box in the frame packaging box according to an embodiment of the present disclosure.

The box 10 also includes bottom spacers 16 and 17 and top spacers 18 and 19 for maintaining a state in which the first supporter 11 and the second supporter 12 are disposed to be spaced apart from each other, as illustrated in FIGS. 3 and 8. Because the bottom spacers 16 and 17 and the top spacers 18 and 19 support the first supporters 11 and the second supporters 12, the numbers of the bottom spacers 16 and 17 and the top spacers 18 and 19 are the same as the numbers of the first supporters 11 and the second supporters 12 forming one layer. In the present embodiment, because ten of the first supporters 11 and ten of the second supporters 12 forming the lowermost layer are provided, the frame packaging box 1 includes ten of the bottom spacers 16 and 17 and ten of the top spacers 18 and 19.

The bottom spacers 16 and 17 are formed in a plate shape and fixed to an upper surface of the bottom cover 14 through an adhesive agent or double-sided tape.

The bottom spacers 16 and 17 include the bottom corner portion spacers 16 to allow the first corner portion supporter 110A and the second corner portion supporter 120A to be spaced apart from each other, and the bottom straight portion spacers 17 to allow the first straight portion supporter 110B and the second straight portion supporter 120B to be spaced apart from each other.

The bottom spacers 16 and 17 include two of first spacer protrusions 16*a* and 17*a* protruding from the upper surfaces of the bottom spacers 16 and 17 in the substantially same shape as the outer support protrusion 111*b* and the inner support protrusion 111*c* of the first supporter 11, and two of second spacer protrusions 16*b* and 17*b* protruding from the upper surfaces of the bottom spacers 16 and 17 in the substantially same shape as the outer support protrusion 121*b* and the inner support protrusion 121*c* of the second supporter 12. The first spacer protrusions 16*a* and 17*a* and the second spacer protrusions 16*b* and 17*b* are provided at positions spaced apart from each other.

The first spacer protrusions 16*a* and 17*a* are inserted into the outer support groove 111*d* and the inner support groove 111*e* of the first supporter 11 forming the lowermost layer among the first supporters 11, and the second spacer protrusions 16*b* and 17*b* are inserted into the outer support groove 121*d* and the inner support groove 121*e* of the second supporter 12 forming the lowermost layer among the second supporters 12.

The top spacers 18 and 19 are formed in a plate shape and attached to a lower surface of the top cover 15 through an adhesive agent or double-sided tape.

The top spacers 18 and 19 include the top corner portion spacers 18 to allow the first corner portion supporter 110A and the second corner portion supporter 120A to be spaced apart from each other, and the top straight portion spacers 19 to allow the first straight portion supporter 110B and the second straight portion supporter 120B to be spaced apart from each other.

The top spacers 18 and 19 include two of first spacer holes 18*a* and 19*a* formed in the substantially same shape as the outer support groove 111*d* and the inner support groove 111*e* of the first supporter 11, and two of second spacer holes 18*b* and 19*b* formed in the substantially same shape as the outer support groove 121*d* and the inner support groove 121*e* of the second supporter 12. The first spacer holes 18*a* and 19*a* and the second spacer holes 18*b* and 19*b* are provided at positions spaced apart from each other.

The outer support protrusions 111*b* and the inner support protrusions 111*c* of the first supporters 11 forming the uppermost layer of the first supporters 11 are inserted into the first spacer holes 18*a* and 19*a*, and the outer support protrusions 121*b* and the inner support protrusions 121*c* of the second supporters 12 forming the uppermost layer of the second supporters 12 are inserted into the second spacer holes 18*b* and 19*b*.

Therefore, the first supporters 11 forming the lowermost layer among the first supporters 11 and the second supporters 12 forming the lowermost layer among the second supporters 12 are maintained in a state of being spaced apart from each other by a predetermined distance by the bottom spacers 16 and 17, and the first supporters 11 forming the uppermost layer among the first supporters 11 and the second supporters 12 forming the uppermost layer among the second supporters 12 are maintained in a state of being spaced apart from each other by a predetermined distance by the top spacers 18 and 19. Accordingly, the first supporters 11 and the second supporters 12 installed in the box 10 may support the first frames F1 and the second frames F2, respectively, in a state of being spaced apart from each other by the predetermined distance.

Hereinafter, a process of accommodating the frames F1 and F2 in the frame packaging box 1 will be described in detail with reference to the drawings.

Figure 2:
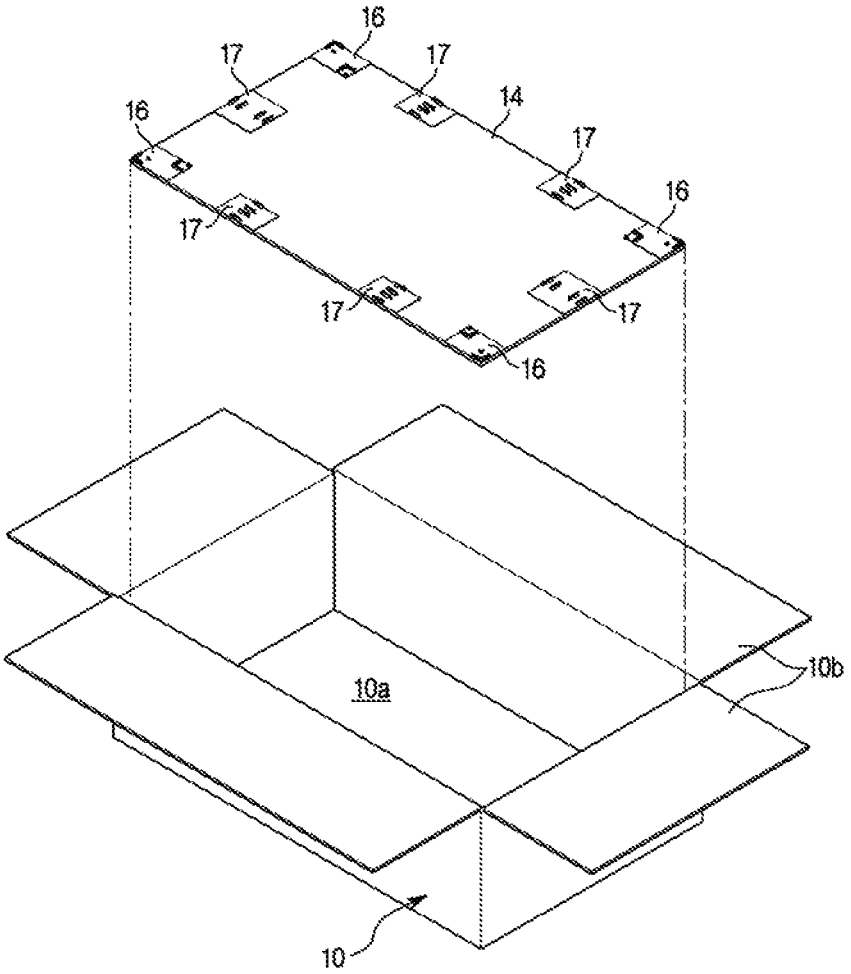
FIG. 2 is a perspective view illustrating a process in which a bottom cover is installed in a box in the frame packaging box according to an embodiment of the present disclosure.

First, as illustrated in FIG. 2, the bottom cover 14 provided with the bottom spacers 16 and 17 is inserted into the accommodating space 10*a* of the box 10 so that the bottom surface of the box 10 is covered by the bottom cover 14, and as illustrated in FIG. 3, the guide rails 13 are installed on the inner surface of the box 10. The order of installing the bottom spacers 16 and 17, the bottom cover 14 and the guide rails 13 may be changed according to the selection of an operator.

Figure 6:
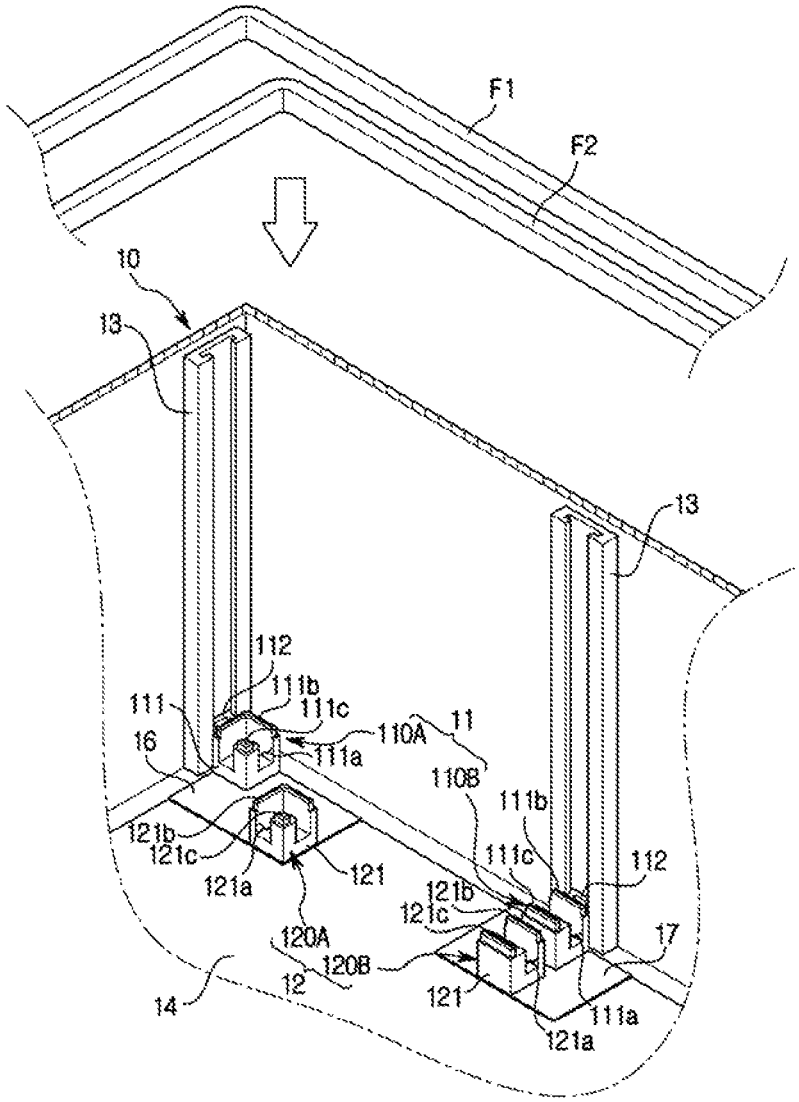
FIG. 6 is a partial perspective view illustrating a process in which frames are accommodated in the frame packaging box according to an embodiment of the present disclosure.

Next, as illustrated in FIG. 4, as the first corner portion supporter 110A and the first straight portion supporter 110B are moved downward after the guide portion 112 provided on the first corner portion supporter 110A and the guide portion 112 provided on the first straight portion supporter 110B are fitted to the guide rail 13, as illustrated in FIG. 6, the first spacer protrusions 16*a* and 17*a* of the bottom spacers 16 and 17 are inserted into the support grooves 111*d* and 111*e* provided on the lower surface of the first corner portion supporter 110A and the lower surface of the first straight portion supporter 110B, so that installation of one of the first corner portion supporter 110A and one of the first straight portion supporter 110B is completed.

By mounting four of the first corner portion supporters 110A and six of the first straight portion supporters 110B on the bottom spacers 16 and 17 in the same manner as above, installation of the first supporters 11 forming the lowermost layer is completed. After installation of the first supporters 11 forming the lowermost layer is completed, one of the first frame F1 is accommodated in the box 10 by seating the first frame F1 in the seating grooves 111*a* of the first supporters 11.

Next, installation of one of the second corner portion supporter 120A and one of the second straight portion supporter 120B is completed by inserting the second spacer protrusions 16*b* and 17*b* of the bottom spacers 16 and 17 into the support grooves 121*d* and 121*e* of the second corner portion supporter 120A and the support grooves 121*d* and 121*e* of the second straight portion supporter 120B.

By mounting four of the second corner portion supporters 120A and six of the second straight portion supporters 120B on the bottom spacers 16 and 17 in the same manner as above, installation of the second supporters 12 forming the lowermost layer is completed. After installation of the second supporters 12 forming the lowermost layer is completed, one of the second frame F2 is accommodated in the box 10 by seating the second frame F2 in the seating grooves 121*a* of the second supporters 12.

Figure 7:
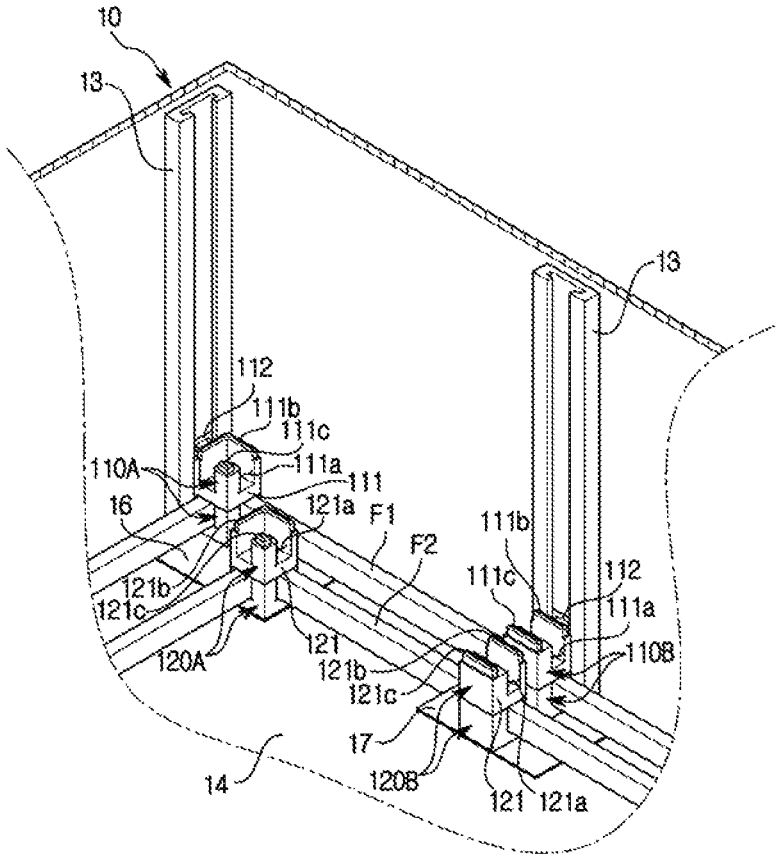
FIG. 7 is a partial perspective view illustrating a state in which the supporters are installed again above the supporters in the frame packaging box according to an embodiment of the present disclosure.

As illustrated in FIG. 7, when one layer of the first supporters 11 are stacked above the stacked first supporters 11 again, the support protrusions 111*b* and 111*c* of the first supporters 11 located at a lower side are inserted into the support grooves 111*d* and 111*e* of the first supporters 11 located at an upper side, so that two of the first supporters 11 neighboring in the up-down direction are supported by each other.

When one layer of the second supporters 12 are stacked above the stacked second supporters 12 again, the support protrusions 121*b* and 121*c* of the second supporters 12 located at a lower side are inserted into the support grooves 121*d* and 121*e* of the second supporters 12 located at an upper side, so that two of the second supporters 12 neighboring in the up-down direction are supported by each other.

In the same manner as above, the first frames F1 are sequentially accommodated in the box 10 as the first supporters 11 are stacked one by one, and the second frames F2 are sequentially accommodated in the box 10 as the second supporters 12 are stacked one by one.

Figure 9:
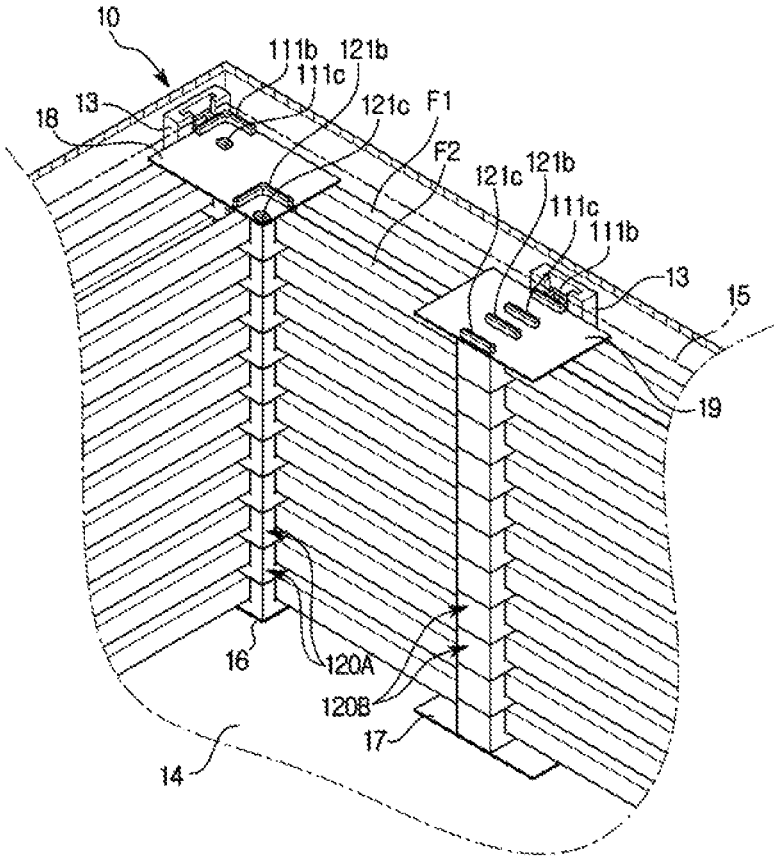

After all the frames F1 and F2 to be accommodated in one of the frame packaging box 1 are accommodated, as illustrated in FIGS. 8 and 9, the accommodating space 10*a* is covered by the top cover 15 having the lower surface to which the top spacers 18 and 19 are attached.

When the top cover 15 covers the accommodating space 10*a*, the support protrusions 111*b* and 111*c* of the first supporters 11 forming the uppermost layer among the first supporters 11 and the support protrusions 121*b* and 121*c* of the second supporters 12 forming the uppermost layer among the second supporters 12 are all inserted into the support holes 18*a*, 18*b*, 19*a*, and 19*b* formed on the top spacers 18 and 19. Therefore, the first supporters 11 and the second supporters 12 placed on the uppermost layer may be maintained in a state of being spaced apart from each other by a predetermined distance by the top spacers 18 and 19.

As described above, the first supporters 11 and the second supporters 12 are maintained in a state of being spaced apart from each other by the bottom spacers 16 and 17 and the top spacers 18 and 19, and thus the first frames F1 and the second frames F2 may be accommodated in a state of being spaced apart from each other in the box.

In the present embodiment, the first supporters 11 are stacked through the support protrusions 111*b* and 111*c* and the support grooves 111*d* and 111*e* as well as the guide rails 13, but the present disclosure is not limited thereto, and the first supporters may be stacked only through the support protrusions and the support grooves without the guide rails. Also, the first supporters may be stacked only through the guide rails without the support protrusions and the support grooves.

In the present embodiment, the frame packaging box is configured such that the first frames F1 and the second frames F2 may be supported through the first supporters 11 and the second supporters 12, but the present disclosure is not limited thereto, and only one type of frames may be accommodated in the frame packaging box through one type of supporters movably installed on the guide rails.

In the present embodiment, the frame packaging box 1 includes four of the corner portion supporters 110A and 120A to accommodate and support the quadrangular ring-shaped frames F1 and F2 having four corners, but the present disclosure is not limited thereto, the frame packaging box may accommodate U-shaped frames or L-shaped frames, and the number of corner portion supporters and straight portion supporters may be variously selected and applied according to the shape and size of the frame.

While the present disclosure has been particularly described with reference to exemplary embodiments, it should be understood by those of skilled in the art that various changes in form and details may be made without departing from the spirit and scope of the present disclosure.

The invention claimed is:

1. A frame packaging box assembly comprising:

a box comprising an accommodating space for accommodating frames;

a plurality of supporters stacked in a vertical direction in the accommodating space to support portions of the frames, wherein the plurality of supporters comprise a plurality of first supporters disposed adjacent to an inner surface of the box and a plurality of second supporters spaced apart from the plurality of first supporter to an inside of the box; and a guide rail disposed on an inner sidewall of the box to guide movement of the plurality of supporters in the vertical direction, wherein the plurality of second supporters comprise a corner portion supporter disposed adjacent to a corner portion of the box to support corner portions of the frames, and a straight portion supporter disposed adjacent to a straight portion of the box to support straight portions of the frames.

2. The frame packaging box assembly according to claim 1, wherein each of the plurality of first supporters comprises a support portion having an upper surface on which a seating groove on which the portions of the frames is seated is formed, and a guide portion extending from one side of the support portion and movably installed on the guide rail.

3. The frame packaging box assembly according to claim 2, wherein each of the plurality of first supporters comprises a support protrusion extending from the upper surface of the support portion, and a support groove formed concavely on a lower surface of the support portion and into which the support protrusion of the supporter located thereunder is inserted.

4. The frame packaging box assembly according to claim 3, wherein each of the plurality of first supporters comprises a corner portion supporter supporting corner portions of the frames, and the corner portion supporter of each of the plurality of first supporters comprises the seating groove formed in an L shape.

5. The frame packaging box assembly according to claim 4, wherein the support protrusion comprises an L-shaped outer support protrusion provided on an outer upper surface with respect to the seating groove, and an inner support protrusion provided on an inner upper surface with respect to the seating groove, and the support groove comprises an L-shaped outer support groove corresponding to the outer support protrusion, and an inner support groove corresponding to the inner support protrusion.

6. The frame packaging box assembly according to claim 3, wherein each of the plurality of first supporters comprises a straight portion supporter supporting a-straight portions of the frames, and the straight portion supporter of each of the plurality of first supporters comprises the seating groove formed in a straight shape.

7. The frame packaging box assembly according to claim 6, wherein the support protrusion comprises a straight-shaped first support protrusion provided on an outer upper surface with respect to the seating groove, and a straight-shaped second support protrusion provided on an inner upper surface with respect to the seating groove, and the support groove comprises a straight-shaped outer support groove corresponding to the outer support protrusion, and a straight-shaped inner support groove corresponding to the inner support protrusion.

8. A frame packaging box assembly comprising:

a box comprising an accommodating space for together accommodating first frames and second frames smaller than the first frames;

a plurality of first supporters disposed adjacent to an inner surface of the box and stacked in a vertical direction to support portions of the first frames; and a plurality of second supporters disposed to be spaced apart from an inner side of the plurality of first supporters to support portions of the second frames, wherein the plurality of second supporters comprise a plurality of second corner portion supporters disposed adjacent to corner portions of the box to support corner portions of the second frames, and a plurality of second straight portion supporters disposed between the plurality of second corner portion supporters to support straight portions of the second frames.

9. The frame packaging box assembly according to claim 8, wherein the box comprises a guide rail disposed on an inner surface of the box to guide movement of the plurality of first supporters in the vertical direction.

10. The frame packaging box assembly according to claim 9, wherein each of the plurality of the first supporters comprises a support portion having an upper surface on which a seating groove on which the portions of the first frames is seated is formed, and a guide portion connected to one side of the support portion and movably installed on the guide rail.

11. The frame packaging box assembly according to claim 8, wherein each of the plurality of first supporters comprises a plurality of first corner portion supporters disposed adjacent to corner portions of the box to support corner portions of the first frames, and a plurality of first straight portion supporters disposed between the plurality of first corner portion supporters to support straight portions of the first frames.

12. The frame packaging box assembly according to claim 11, wherein the plurality of first corner portion supporters comprises the seating groove formed in an L shape, and the plurality of first straight portion supporters comprises the seating groove formed in a straight shape.

13. The frame packaging box assembly according to claim 8, wherein each of the plurality of the second supporters comprises a support portion having an upper surface on which a seating groove on which the portions of the second frames is seated is formed.

14. The frame packaging box assembly according to claim 8, wherein the box further comprises bottom spacers configured to maintain the plurality of first supporters forming the lowermost layer among the plurality of first supporters and the plurality of second supporters forming the lowermost layer among the plurality of second supporters in a state of being spaced apart from each other, and top spacers configured to maintain the plurality of first supporters forming the uppermost layer among the plurality of first supporters and the plurality of second supporters forming the uppermost layer among the plurality of second supporters in a state of being spaced apart from each other.

15. The frame packaging box assembly according to claim 14, wherein each of the plurality of first supporters comprises a support protrusion protruding from an upper surface of each of the plurality of first supporters, and a support groove formed concavely from a lower surface of each of the plurality of first supporters into which support protrusion of each of the plurality of first supporters is inserted, each of the plurality of second supporters comprises a support protrusion protruding from an upper surface of each of the plurality of second supporters, and a support groove formed concavely from a lower surface of each of the plurality of second supporters into which the support protrusion of each of the plurality of second supporters is inserted.

16. The frame packaging box assembly according to claim 15, wherein each of the bottom spacers comprises first spacer protrusions inserted into the support grooves of the plurality of first supporters, and second spacer protrusions inserted into the support grooves of the plurality of second supporters.

17. The frame packaging box assembly according to claim 15, wherein each of the top spacers comprises first spacer holes into which the support protrusions of the plurality of first supporters are inserted, and second spacer holes into which the support protrusions of the plurality of second supporters are inserted.

* * * * *